US009937101B2

(12) United States Patent
Sheu

(10) Patent No.: US 9,937,101 B2
(45) Date of Patent: Apr. 10, 2018

(54) PORTABLE MEDICINE FEEDER

(71) Applicant: Miin-Tsang Sheu, Changhua County (TW)

(72) Inventor: Miin-Tsang Sheu, Changhua County (TW)

( * ) Notice: Subject to any disclaimer, the term of this patent is extended or adjusted under 35 U.S.C. 154(b) by 0 days.

(21) Appl. No.: 15/725,424

(22) Filed: Oct. 5, 2017

(65) Prior Publication Data

US 2018/0028405 A1 Feb. 1, 2018

Related U.S. Application Data

(63) Continuation-in-part of application No. 14/793,911, filed on Jul. 8, 2015.

(51) Int. Cl.

| | |
|---|---|
| ***B65D 83/04*** | (2006.01) |
| ***A61J 7/00*** | (2006.01) |
| ***B65D 47/06*** | (2006.01) |
| *A61J 7/02* | (2006.01) |

(52) U.S. Cl.

CPC ..... *A61J 7/0069* (2013.01); *A61J 7/0015* (2013.01); *B65D 47/06* (2013.01); *A61J 7/0076* (2013.01); *A61J 7/02* (2013.01)

(58) Field of Classification Search

CPC .... B65D 21/0206; B65D 43/16; B65D 43/22; B65D 83/0481; A61J 1/03

USPC ..... 206/528, 530, 534.1, 538–540; 220/4.21–4.23, 23.2, 23.4, 23.8

See application file for complete search history.

(56) References Cited

U.S. PATENT DOCUMENTS

| | | | | | |
|---|---|---|---|---|---|
| 4,253,572 | A * | 3/1981 | Halbich | B65D 83/0445 | 206/538 |
| 4,483,626 | A * | 11/1984 | Noble | G04B 19/264 | 368/10 |
| 4,793,492 | A * | 12/1988 | Halbich | A45C 11/24 | 206/538 |
| 5,975,305 | A * | 11/1999 | Barger | A61J 7/0023 | 206/572 |
| 6,364,519 | B1 * | 4/2002 | Hughes | A61B 17/8833 | 220/221 |
| 6,957,909 | B1 * | 10/2005 | Dingeldein | B65D 75/36 | 220/221 |
| 8,511,500 | B2 * | 8/2013 | Teys | B65D 43/162 | 220/4.23 |

(Continued)

*Primary Examiner* — Luan K Bui
(74) *Attorney, Agent, or Firm* — Jackson IPG PLLC; Demian K. Jackson

(57) ABSTRACT

A portable medicine feeder includes at least two medicine boxes placed in juxtaposition to be integrally arranged. Each medicine box has an accommodation portion and block walls perpendicularly extending upwards from a bottom of the accommodation portion wherein at least one block wall is shared. A gradually-reduced guide channel extends forwards and upwards from the bottom of the accommodation portion. An included angle of at least 120 degrees is defined between the slope of the gradually-reduced guide channel and the bottom of the accommodation portion so that an outlet formed at a front end of the gradually-reduced guide channel has a width much smaller than that of the accommodation portion. A gap is formed between the adjacent outlets of the adjacent medicine boxes. The gap and the gradually-reduced guide channel can go into the corner of the mouth and the lower lip of the taker.

4 Claims, 4 Drawing Sheets

(56) References Cited

U.S. PATENT DOCUMENTS

2009/0166243 A1* 7/2009 Cetera ..... A61J 1/03
206/528

* cited by examiner

PORTABLE MEDICINE FEEDER

BACKGROUND OF THE INVENTION

1. Field of the Invention

This invention relates particularly to a device including at least two medicine boxes placed in juxtaposition to be integrally arranged and a lid adapted to each medicine box. A gap is formed between outlets at respective front ends of the gradually-reduced guide channels of the adjacent medicine boxes. Therefore, the unused medicine boxes can be gripped by the taker, and the taker can put the gap into the corner of the mouth to allow the gradually-reduced guide channel of the selected medicine box to go deep into the mouth and prevent the inside medicine from dropping from two sides of the box.

2. Description of the Related Art

There are different kinds of storage boxes made to receive and store articles. To separate or accommodate different kinds of medicine, a well-known medicine box usually has a specific design to separate medicine pieces or arranging them into classes according to dosages. The medicine box can be put into the pockets of trousers or clothes for easy carrying. However, the box is easily pressed by external force and unintentially opened. This situation may pollute the inside medicine or mix up the medicine pieces. Therefore, this problem should be prevented.

To take the medicine, the taker usually puts medicine pieces on the hand and feeds the pieces into the mouth. This feeding operation is not convenient and is easy to contaminate the medicine pieces. If the taker takes the medicine by putting the box into the mouth directly, the medicine pieces may fail to go into the mouth because they may drop from the two sides of the box easily. Therefore, the feeding operation still has problems.

SUMMARY OF THE INVENTION

The portable medicine feeder of this invention includes at least two medicine boxes placed in juxtaposition to be integrally arranged. Each of the medicine boxes includes an accommodation portion and block walls perpendicular to the accommodation portion. A front portion slopes upwards from the accommodation portion to provide an angle of at least 120 degrees between the front portion and the accommodation portion. A gradually-reduced block wall is formed at a front section of a place where the accommodation portion is connected to the block walls. A gradually-reduced guide channel is formed between the gradually-reduced block wall, thereby allowing an outlet formed at a top end of the gradually-reduced guide channel to have a width much smaller than a width of the accommodation portion and forming a gap between the adjacent outlets of the adjacent medicine boxes. Accordingly, the unused medicine boxes can be conveniently gripped by the taker, and the taker can put the gap into the corner of the mouth so that the gradually-reduced guide channel of the selected medicine box goes deep into the mouth to prevent the inside medicine from dropping from two sides of the box.

This invention also includes a lid integrally connected to the medicine box at a top end of a block wall which is formed in the rear of the accommodation portion. The lid, adapted to cover the medicine box, has a sealing ring fitting in with the contour of the medicine box. The lid can have a reinforced plate formed on a top face thereof, opposite to the sealing ring. A locking lip is disposed at a front end of the lid, and a locking slot is formed on an inner edge of the locking lip.

When the medicine box is covered by the lid, the sealing ring is embedded in the inner periphery of the medicine box and the locking lip is engaged with the outlet of the medicine box to allow the outlet to be lodged in the locking slot. Therefore, the lid is not deformed and the lid and the medicine box are firmly locked with each other to prevent the lid from being unintentionally opened.

In some embodiments, there can be a plurality of medicine boxes placed in juxtaposition to be integrally arranged. Each lid of each medicine box and each rear block wall of each medicine box can be integrally connected with each other. A gap is formed between the adjacent outlets at respective front ends of the gradually-reduced guide channels of any two adjacent medicine boxes. A locking lip is disposed at a front end of each lid, and a locking slot is formed on the locking lip. Therefore, the outlet of the medicine box can be lodged in the locking slot and fixed in position.

The features of this invention to solve the aforementioned problems includes: (1) at least two medicine boxes placed in juxtaposition to be integrally arranged and a lid adapted to cooperate with each medicine box. The medicine box has an accommodation portion from which a portion slopes with a slope equal to or above 120 degrees and cooperates with block walls at two sides of the accommodation portion gradually reduced to an outlet at the top end to form a gradually-reduced guide channel, and a gap formed between the adjacent outlets of the juxtaposed medicine boxes; and (2) a sealing ring is located on the lid relative to an inner periphery of the medicine box. A locking lip is dispose at the front end of the lid, and a locking slot is formed on an inner edge of the locking lip. Therefore, the outlet at the front end of the medicine box can be well sealed.

The object of this invention is to provide a portable medicine box which can: (1) use the gradually-reduced guide channel of the at least two juxtaposed medicine boxes and the gap formed between the adjacent outlets to allow the gradually-reduced guide channel to go deep into the mouth and prevent the inside medicine from dropping from the two sides of the box; (2) allow the unused medicine boxes to function as a handle which facilitates easy carrying of the taker when the selected one of the medicine boxes is opened for pouring the medicine into the mouth; and (3) use the sealing ring of the lid and the locking lip at the front end of the lid to prevent moisture from entering the medicine box and prevent the lid from being unintentionally opened because of any improper press.

DETAILED DESCRIPTION OF THE PREFERRED EMBODIMENTS

Figure 1:
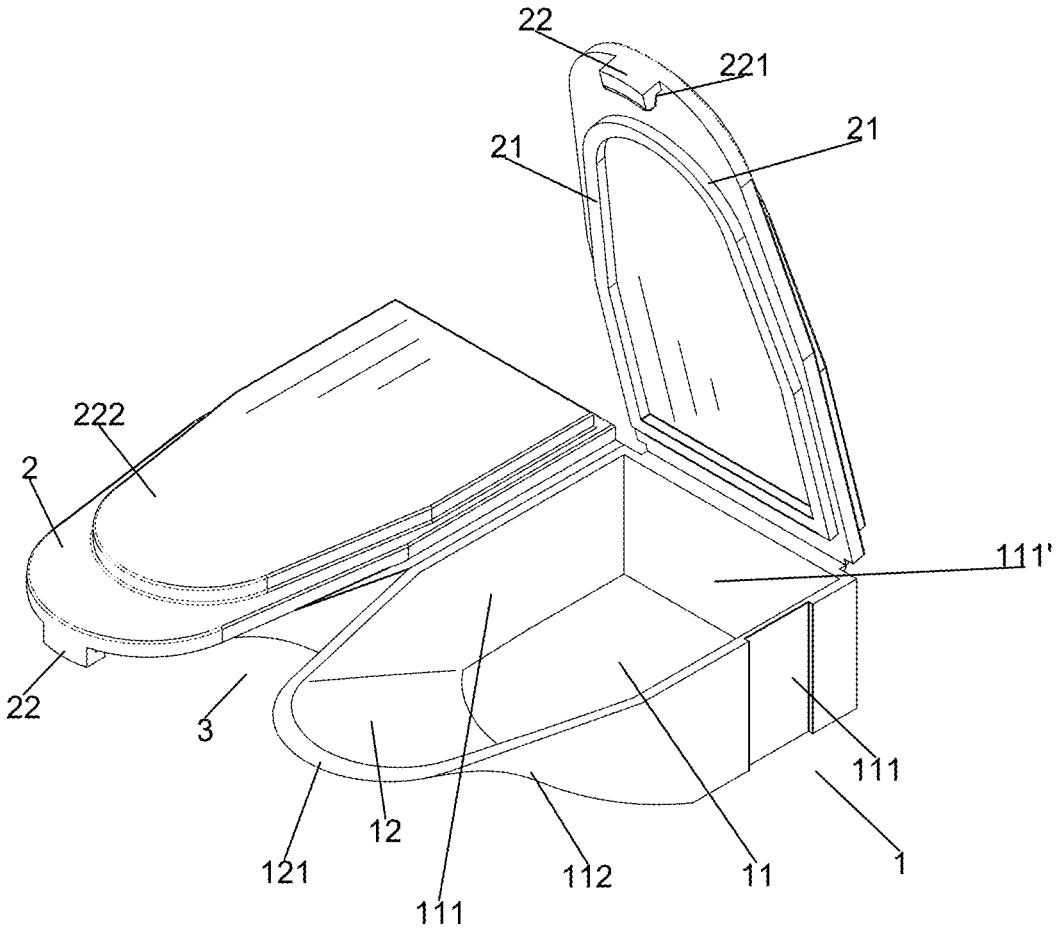
FIG. 1 is an exploded view showing a preferred embodiment of this invention.
Figure 2:
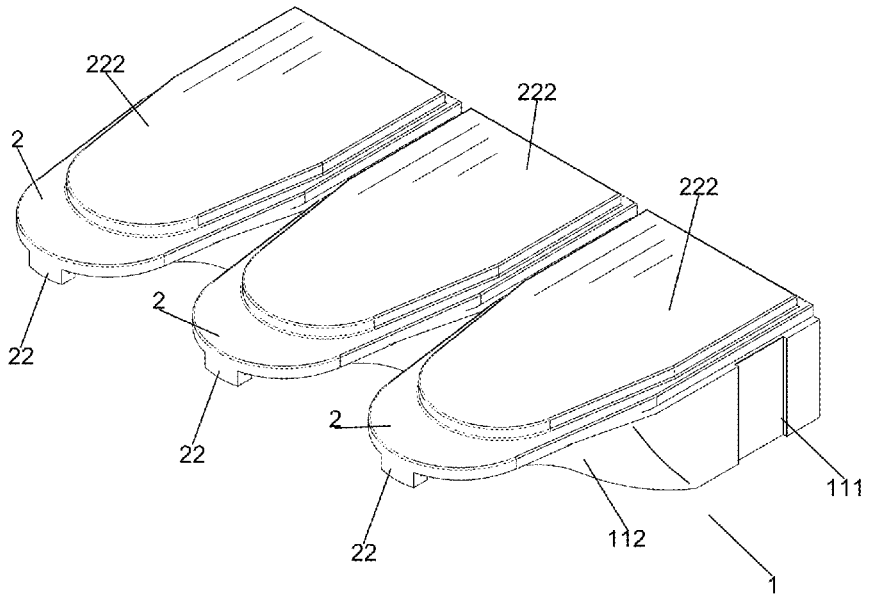
FIG. 2 is a right side elevational view showing the preferred embodiment of this invention in juxtaposition.
Figure 3:
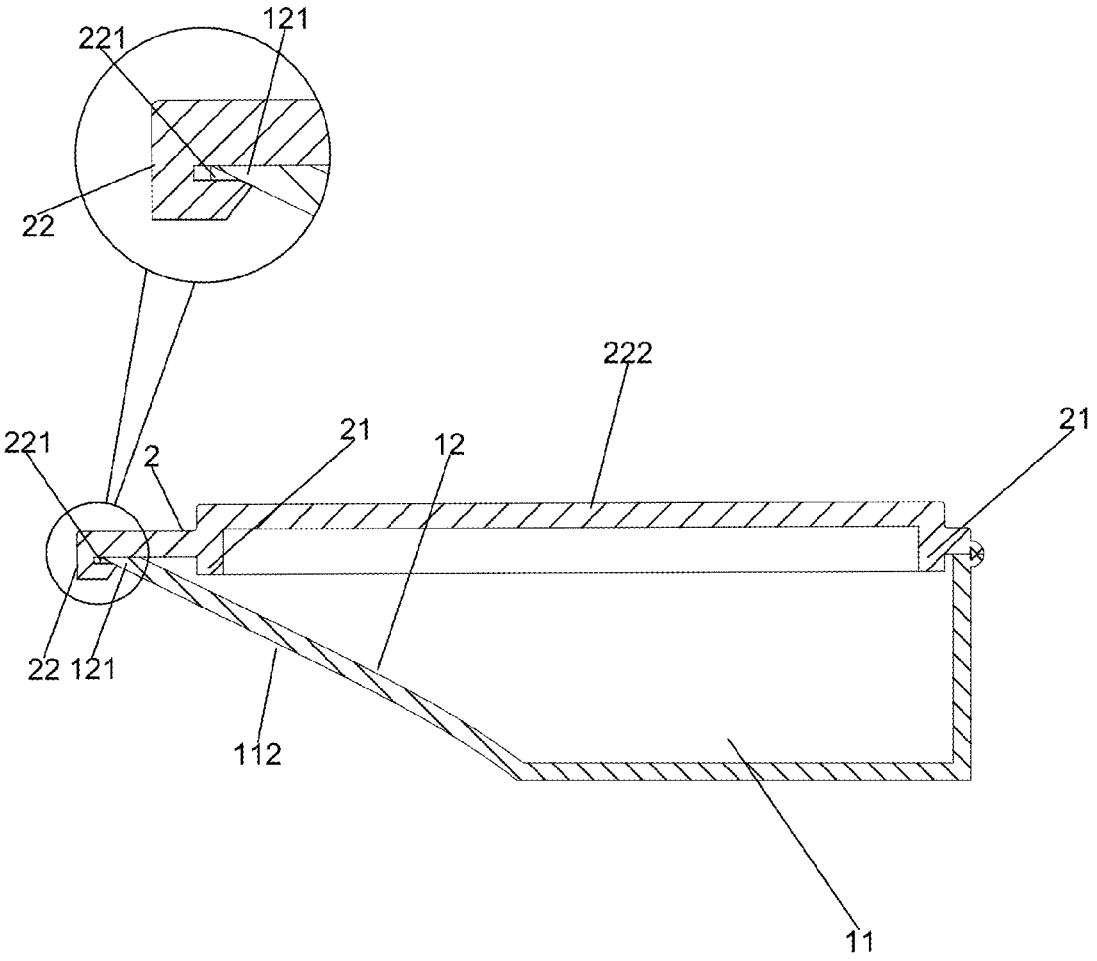
FIG. 3 is a schematic view showing the preferred embodiment of this invention in use.

Referring to FIGS. 1-4, a preferred embodiment of this invention includes at least two medicine boxes 1 placed in juxtaposition to be integrally arranged. Each of the medicine boxes 1 includes an accommodation portion 11 and block walls 111 perpendicular to the accommodation portion 11. A front portion slopes upwards from the accommodation portion 11 to provide an angle of at least 120 degrees between the front portion and the accommodation portion 11. A gradually-reduced block wall 112 is formed at a front section of a place where the accommodation portion 11 is connected to the block walls 111. A gradually-reduced guide channel 12 is formed between the gradually-reduced block wall 112 in order that an outlet 121 formed at a top end of the gradually-reduced guide channel 12 has a width much smaller than a width of the accommodation portion 11, and a gap 3 is formed between the adjacent outlets 121 of the medicine boxes 1. This arrangement allows the unused medicine boxes 1 to function as a handle capable of being conveniently gripped by the taker, and the gap 3 can go into the corner of the mouth to allow the gradually-reduced guide channel 12 to go deep into the mouth. Therefore, the inside medicine does not drop from the two sides of the box 1.

This invention also includes a lid 2 integrally connected to the medicine box 1 at a top end of a rear block wall 111' which is formed in the rear of the accommodation portion 11. The lid 2 has a sealing ring 21 formed on a place which fits in with a contour of an inner periphery of the medicine box 1. A reinforced plate 22 is disposed on a top face of the lid 2, opposite to the sealing ring 21. A locking lip 22 is disposed at a front end of the lid 2, and a locking slot 221 is formed on an inner edge of the locking lip 22. When the medicine box 1 is covered by the lid 2, the sealing ring 21 is embedded in the inner periphery of the medicine box 1 and the locking lip 22 is engaged with the outlet 121 of the medicine box 1 to allow the outlet 121 to be lodged in the locking slot 221 of the locking lip 22. The reinforced plate 222 is applied to strengthen the lid 2 to prevent the deformation of its wall and allow the lid 2 and the medicine box 1 to fasten together. Therefore, the lid 2 is not opened unintentionally.

Figure 4:
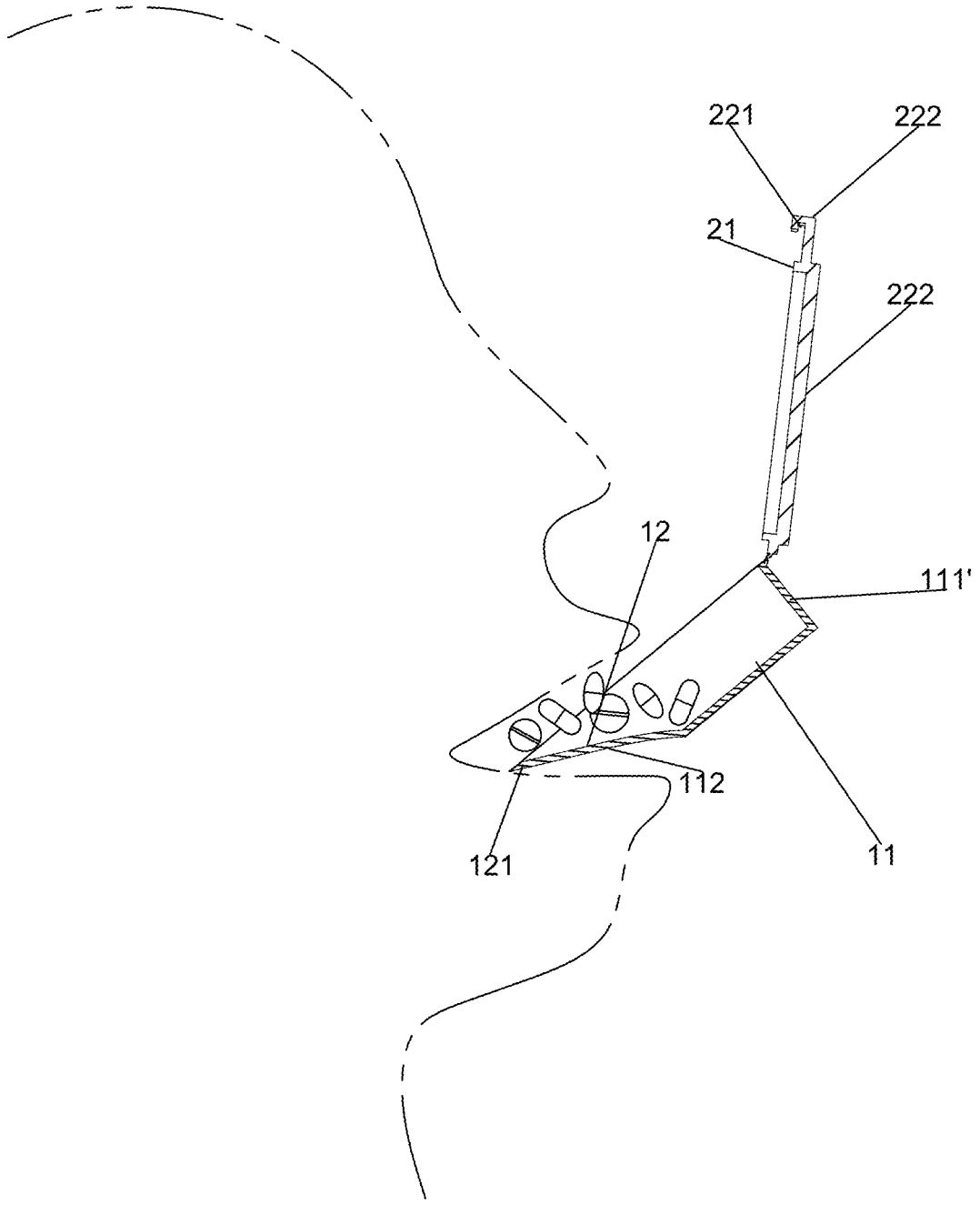
FIG. 4 is a schematic view showing another preferred embodiment of this invention in use.

In some preferred embodiments, FIG. 4 shows that a plurality of medicine boxes 1 can be placed in juxtaposition to be integrally arranged. Each lid 2 of each medicine box 1 and each rear block wall 111' of each medicine box 1 can be integrally connected with each other. Because of the juxtaposed medicine boxes 1, the unused medicine boxes 1 function as a handle capable of being gripped by the taker when a selected one of the medicine boxes 1 is used.

A portable medicine feeder includes at least two medicine boxes placed in juxtaposition to be integrally arranged. Each medicine box has an accommodation portion and block walls perpendicularly extending upwards from a bottom of the accommodation portion wherein at least one block wall is shared. A gradually-reduced guide channel extends forwards and upwards from the bottom of the accommodation portion. An included angle of at least 120 degrees is defined between the slope of the gradually-reduced guide channel and the bottom of the accommodation portion so that an outlet formed at a front end of the gradually-reduced guide channel has a width much smaller than that of the accommodation portion. A gap is formed between the adjacent outlets of the adjacent medicine boxes. The gap and the gradually-reduced guide channel can go into the corner of the mouth and the lower lip of the taker. Other unused medicine boxes can function as a handle gripped by the taker to allow the medicine to slide into the mouth directly through the gradually-reduced guide channel. A lid is included and is integrally connected to a top end of a rear block wall of the accommodation portion. The lid has a sealing ring fitting in with the contour of the medicine box. A reinforced plate is disposed on a top face of the lid. A locking lip is disposed at a front end of the lid. A locking slot is formed on an inner edge of the locking lip. When the medicine box is covered by the lid, the sealing ring is embedded in the inner periphery of the medicine box and the locking lip is engaged with the outlet of the medicine box to allow the outlet to be lodged in the locking slot, thereby fastening the lid and the medicine box together to prevent the lid from being unintentionally opened.

To sum up, this invention is different from the traditional medicine dispenser. The medicine feeder of this invention takes advantage of each gradually-reduced guide channel 12 of at least two juxtaposed medicine boxes and each gap 3 therebetween to allow the medicine box to go deep into the mouth. The invention also uses the lid structure to cooperate with the medicine box, thereby attaining a good fastening effect and preventing the entry of moisture. Therefore, this invention is inventive and it is believed that the invention can be placed in condition for allowance, and such action is respectfully requested.

What is claimed is:

1. A portable medicine feeder comprising:

at least two medicine boxes placed in juxtaposition to be integrally arranged, each of said at least two medicine boxes including an accommodation portion and block walls perpendicular to said accommodation portion, a front portion sloping upwards from said accommodation portion to provide an angle of at least 120 degrees between said front portion and said accommodation portion, a gradually-reduced block wall being formed at a front section of a place where said accommodation portion is connected to said block walls, a gradually-reduced guide channel being formed between said gradually-reduced block wall in order that an outlet formed at a top end of said gradually-reduced guide channel has a width much smaller than a width of said accommodation portion, and a gap is formed between said adjacent outlets of said adjacent medicine boxes; and a lid mounted in position relative to each of said medicine boxes, said lid being integrally connected to said medicine box at a top end of a rear block wall which is formed in the rear of said accommodation portion, said lid including a sealing ring formed on a place which fits in with a contour of an inner periphery of said medicine box, a locking lip being disposed at a front end of said lid, a locking slot being formed on an inner edge of said locking lip;

wherein when said medicine box is covered by said lid, said sealing ring being embedded in said inner periphery of said medicine box and said locking lip being engaged with said outlet of said medicine box to allow said outlet to be lodged in said locking slot of said locking lip, thereby fastening said lid and said medicine box together and allowing said medicine box to go deep into a mouth of a taker through said gradually-reduced guide channel and said gap.

2. The portable medicine feeder as claimed in claim 1, wherein there are a plurality of medicine boxes placed in juxtaposition to be integrally arranged, each lid of each of said medicine boxes and each rear block wall of each of said medicine boxes being integrally connected with each other.

3. The portable medicine feeder as claimed in claim 1, wherein there are a plurality of medicine boxes placed in juxtaposition to be integrally arranged, other unused medicine boxes functioning as a handle capable of being gripped by said taker when a selected one of said medicine boxes is used.

4. The portable medicine feeder as claimed in claim 1, wherein a reinforced plate is formed on a top face of said lid.

* * * * *